US007753826B1

(12) United States Patent
Oliver et al.

(10) Patent No.: US 7,753,826 B1
(45) Date of Patent: Jul. 13, 2010

(54) HIGH JUMP AND POLE VAULT PIT LANDING SYSTEMS HAVING INTEGRATED DRAINAGE AND METHODS FOR FORMING THE SAME

(75) Inventors: Wayne P. Oliver, Delhi, NY (US); Peter L. Harvey, Salisbury, NC (US); Matthew Cross, Salisbury, NC (US); David J. Moxley, Delancey, NY (US); Michael Smoak, Kennesaw, GA (US)

(73) Assignee: Sportsfield Specialties, Inc., Delhi, NY (US)

( * ) Notice: Subject to any disclaimer, the term of this patent is extended or adjusted under 35 U.S.C. 154(b) by 0 days.

(21) Appl. No.: 12/405,783

(22) Filed: Mar. 17, 2009

(51) Int. Cl.
*A63B 21/00* (2006.01)

(52) U.S. Cl. ..... 482/23; 482/35

(58) Field of Classification Search ..... 482/35, 482/23, 22, 14, 27, 30, 31; 182/137
See application file for complete search history.

(56) References Cited

U.S. PATENT DOCUMENTS

| | | | | |
|---|---|---|---|---|
| 3,027,967 | A * | 4/1962 | Silver | 182/137 |
| 3,965,507 | A | 6/1976 | Reiland | 272/104 |
| 4,057,245 | A | 11/1977 | Gordon | 272/101 |
| 4,215,857 | A | 8/1980 | Gordon | 272/101 |
| 7,244,477 | B2 | 7/2007 | Sawyer et al. | 428/17 |

* cited by examiner

*Primary Examiner*—Jerome Donnelly
(74) *Attorney, Agent, or Firm*—Heslin Rothenberg Farley & Mesiti P.C.

(57) ABSTRACT

In one embodiment, a pit landing system having integrated drainage positionable on a surface of a ground includes an upper padding section and a lower support section. The lower support section includes a lower water permeable support operable to allow water to permeate through its structure while supporting the padding layer above the surface of the ground. The upper section includes a cover and the lower support section comprises a porous cover. High jumps and pole vaults including the pit landing system are also disclosed. Methods for forming the pit landing system and methods for protecting an athlete are also disclosed.

57 Claims, 6 Drawing Sheets

HIGH JUMP AND POLE VAULT PIT LANDING SYSTEMS HAVING INTEGRATED DRAINAGE AND METHODS FOR FORMING THE SAME

FIELD OF THE INVENTION

This invention relates generally to high jumps and pole vaults, and more particularly to high jump and pole vault pit landing systems having integrated drainage and methods for forming the same.

BACKGROUND OF THE INVENTION

Existing high jump and pole vault pits consist of foam and vinyl fabricated and assembled to provide adequate cushioning to an athletic participant. More than 90 percent of these pits are used outdoors exposing them to varying weather and ground surface conditions. In many cases they are positioned in less than desirable location which allow the lower portion of the pits to sit in water, mud or both. This constant exposure prematurely degrades the vinyl and foam resulting in a less than desirable serviceable life span. Such pits are disclosed in U.S. Pat. No. 4,215,857 issued to Gordon, and U.S. Pat. No. 4,057,245 issued to Gordon.

To offset this concern manufacturers offer pallets made from wood, plastic or metal, which raise the jump pit off the ground allowing water to drain away from the product and air to circulate around the components of the pit creating a drying effect. For example, U.S. Pat. No. 3,965,507 issued to Reiland discloses an athlete' landing pit cushion having a wooden support structure for keeping the landing cushion off the ground.

U.S. Pat. No. 7,244,477 issued to Sawyer et al. discloses a multi-layered sports playing field with a water draining, padding layer. The multi-layered sports playing field includes a top layer made of substantially artificial material simulating a natural playing surface such as grass and a padding layer positioned between the top layer and the base or dirt layer. The padding layer is made of a plurality of discrete beads of substantially elastic, resilient material with portions of adjacent beads abutting one another and other portions being spaced from each other. Substantially all of the adjacent beads are preferably integrally joined together at their abutting portions. The padding layer is porous and breathable and preferably includes feet members supporting the main body of the padding layer above the base or dirt layer to create a water channel of interconnected portions to enhance water drainage to the sides of the field.

There is a need for further high jump and pole vault pit landing systems, and more particularly to high jump and pole vault pit landing systems having integrated drainage and methods for forming the same.

SUMMARY OF THE INVENTION

In a first aspect, the present invention provides a pit landing system having integrated drainage positionable on a surface of a ground for at least one of a high jump and a pole vault. The pit landing system includes an upper padding section and a lower support section. The upper padding section includes an upper padding having an upper surface, a bottom surface, side surfaces extending between the upper surface and the bottom surface, and a thickness between the upper surface and the bottom surface of greater than about 20 inches, and a cover covering the upper surface and the side surfaces of the upper padding layer. The lower support section is disposed below the lower surface of the upper padding, and includes a lower water permeable support having an upper surface, a bottom surface, and a thickness between the upper surface and the bottom surface of the lower support greater than about 2 inches. The upper padding comprises a first material, and the lower water permeable support comprises a second material which is different from the first material. The lower support is operable to allow water to permeate through its structure while supporting the padding layer above the surface of the ground. A porous cover extends from the upper cover and covering side surfaces of the lower support.

In a second aspect, the present invention provides a pit landing system having integrated drainage positionable on a surface of a ground for at least one of a high jump and a pole vault. The pit landing system includes an upper padding section and a lower support section. Upper padding section includes an upper padding having an upper surface, a bottom surface, side surfaces extending between the upper surface and the bottom surface, and a thickness between the upper surface and the bottom surface of greater than about 20 inches. Upper cover covers the upper surface and the side surfaces of the upper padding layer. The lower support section is disposed below the lower surface of the upper padding. The upper padding comprises a first material, and the lower water permeable support comprises a second material which is different from the first material. The lower support section includes a lower water permeable support having an upper surface, a bottom surface, and a thickness between the upper surface and the bottom surface of the lower support greater than about 2 inches. The lower support includes a plurality of discrete beads of substantially elastic, resilient material wherein portions of adjacent beads abut one another and other portions of the adjacent beads are spaced from each other to create interstitial spaces therebetween and wherein substantially all of the adjacent beads are integrally joined together at the abutting portions thereof. The lower support also includes a plurality of horizontally disposed intersecting members defining a plurality of open spaces extending between the intersecting member and extending from the bottom surface of the upper padding and the bottom surface of the lower support, and the open spaces comprising greater than about 50-percent of the lower support. The porous cover covers the bottom surface and the side surfaces of the lower support.

In a third aspect, the present invention provides a high jump which includes the above-noted pit landing system, a plurality of uprights disposable along side the pit landing system, and a crossbar disposable between the plurality of uprights.

In a fourth aspect, the present invention provides a pole vault which includes the above-noted pit landing system, a plurality of uprights disposable along side the pit landing system, and a crossbar disposable between the plurality of uprights.

In a fifth aspect, the present invention provides a method for protecting an athlete performing at least one of a high jump and a pole vault. The method includes providing the pit landing system as noted above on a field, positioning a plurality of uprights along side the pit landing system, positioning a crossbar between the plurality of uprights, and receiving the athlete on pit landing system after the athlete at least one of attempts to pass over and passes over the crossbar.

In a sixth aspect, the present invention provides a method for forming a pit landing system having integrated drainage for at least one of a high jump and a pole vault. The method includes providing an upper padding formed from a first material, providing a lower water permeable support formed from a second material operable to allow water to permeate through its structure and to support the upper padding off of a surface of the ground, the first material begin different from the second material, providing a cover disposed over an upper surface and side surfaces of the upper padding, and providing a porous cover extending from the upper cover to the ground.

In a seventh aspect, the present invention provides a method for forming a pit landing system having integrated drainage for at least one of a high jump and a pole vault. The method includes providing an upper padding formed from a first material, and providing a plurality of members comprising a second material different from the first material. The second material is operable to allow water to permeate through its structure and to support the upper padding off of a surface of the ground, and comprises a plurality of discrete beads of substantially elastic, resilient material wherein portions of adjacent beads abut one another and other portions of the adjacent beads are spaced from each other to create interstitial spaces therebetween and wherein substantially all of the adjacent beads are integrally joined together at the abutting portions thereof. The plurality of members are positioned below the upper padding to define a plurality of horizontally disposed intersecting member having open spaces extending between the intersecting members and extending from the bottom surface of the upper padding and the bottom surface of the lower support. A cover is disposed over an upper surface and side surfaces of the upper padding, and a porous cover is provided and extends from the upper cover to the ground.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

The present invention is directed to high jumps and pole vaults, and in particular, to high jump and pole vault pit landing systems having integrated drainage and methods for forming same. The present invention eliminates the need for and the additional expensive associated with providing wood or plastic "pallets" underneath conventional pit landing systems. In addition, the present invention solves the problem of degradation of conventional pit landing systems if left to sit in wet or muddy environments, resulting in premature failure.

In one embodiment of the present invention, a drainage system is built into and the bottom of the high jump and pole vault pit landing system. For example, the high jump and pole vault pit landing system may include a padding section and the addition of a synthetic drainage support held in place by a mesh fiber system.

Figure 1:
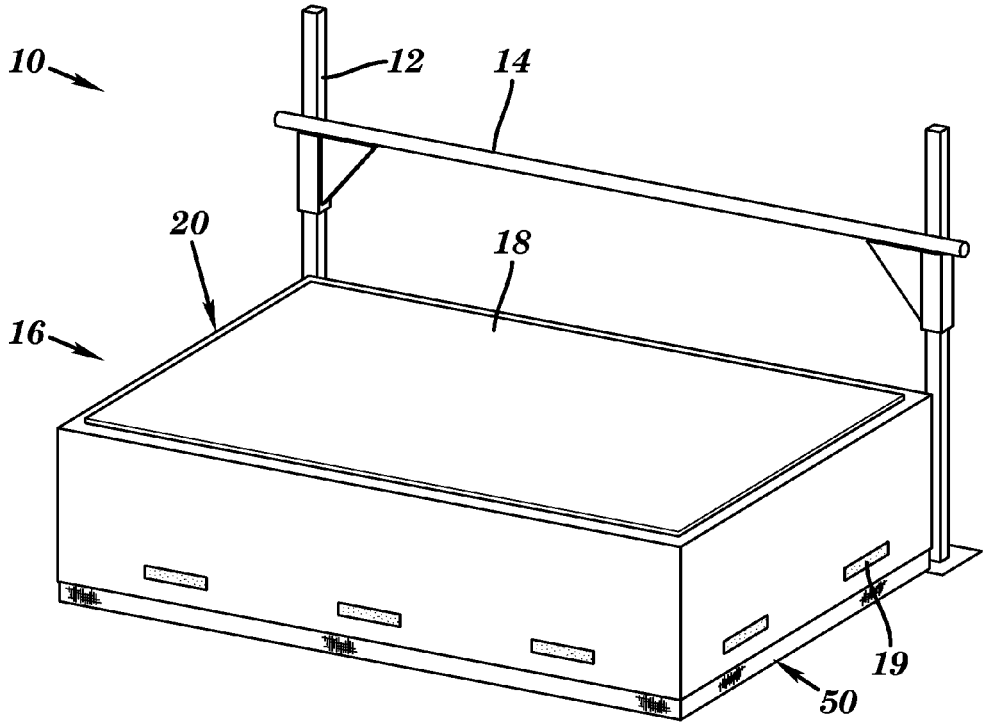
FIG. 1 is a perspective view of one embodiment of a high jump in accordance with the present invention.

FIG. 1 illustrates one embodiment of a high jump 10 which may include a plurality of uprights 12, a crossbar 14, and a pit landing system 16 having an integrated drainage system in accordance with the present invention. High jump pit landing system 16 includes an upper padding section 20 and a lower support section 50. A 2-inch pad 18 may be disposed on top of the pit landing system to protect the upper surface of upper padding section 20. Top pad 18 may be a foam pad covered with heavy-duty vinyl coated polyester mesh that is ultraviolet and spike resistant. A plurality of handles 19 may be provided along the sides of the pit landing system for use in lifting and positioning the pit landing system on a surface of a field such as on the ground within or along side an oval running track. Handles 19 may be 2-inch wide nylon web handles.

Figure 2:
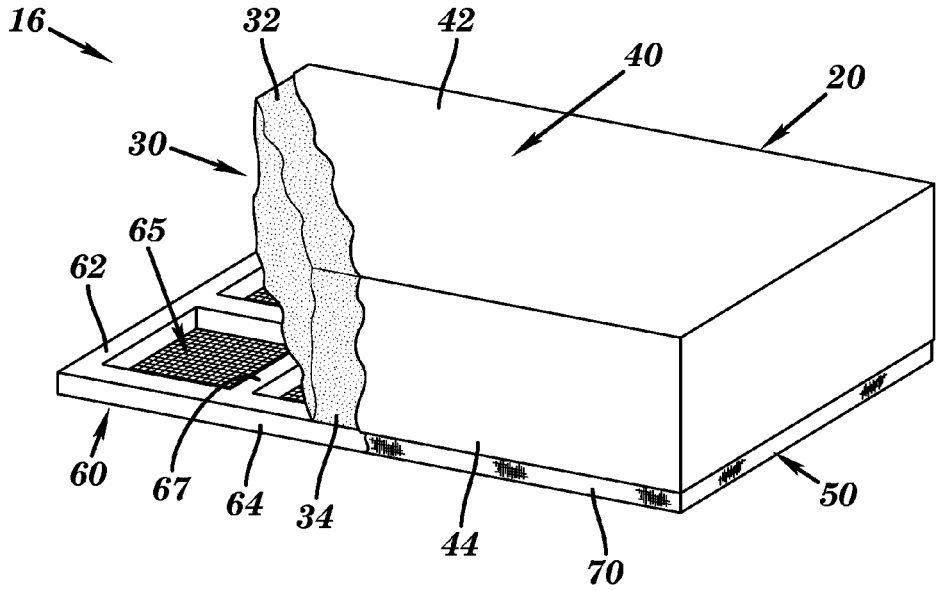
FIG. 2 is a perspective view, partially cutaway, of the high jump pit landing system having integrated drainage of FIG. 1.

As best shown in FIG. 2, upper padding section 20 includes an upper padding 30 and an upper cover 40. Upper padding 30 may include an upper horizontal surface 32, peripherally-extending side surfaces 34 (only of which is shown in FIG. 2), and a horizontal bottom surface (not shown in FIG. 2). The peripherally-extending side surfaces may include a vertical front side surface, a vertical rear side surface, and vertical right, and left side surfaces. The thickness of the upper padding between the upper surface and the bottom surface is greater than about 20 inches. The material forming the upper padding may include a suitable "honeycomb" polyurethane foam core comprising different layers.

Upper cover 40 generally covers upper padding 30. For example, cover 40 may be a non-porous cover having a upper portion 42 covering upper surface 32 of upper padding 30, and a peripherally-extending side portion 44 covering peripherally-extending side surfaces 34 of upper padding 30. The peripherally-extending portion 44 of cover 40 may include a vertical front side surface, a vertical rear side surface, and vertical right, and left side surfaces. Cover portion 40 may be formed form a vinyl material. For example, the non-porous cover portion may be an 18 oz. heavy coated vinyl polyester that has high tear and tensile strengths.

Lower support section 50 comprises a lower support 60 and a lower cover 70. Lower support section 50 is disposed below the lower surface of upper padding section 20. Lower support 60 may include an upper surface 62, peripherally-extending side surfaces 64 (only of which is shown in FIG. 2), and a bottom surface (not shown in FIG. 2). The peripherally-extending side surfaces may include a vertical front side surface, a vertical rear side surface, and vertical right and left side surfaces. The thickness of the lower support between the upper surface and the bottom surface of the lower support may be greater than about 2 inches. For example, the thickness may be about 2 inches, about 5 inches, or greater. As described in greater detail below, the material forming the lower support may be operable to allow water to permeate through its structure while supporting the padding layer above the surface of the ground.

Lower porous cover 70 may cover the peripherally-extending side surfaces and the bottom surface of lower support 60. For example, the lower cover may extend across the entire bottom surface of the lower support. Lower porous cover 70 may be formed from a vinyl mesh material. For example, lower porous cover 70 may be formed from a 10 oz. woven vinyl coated polyester mesh manufactured and available from BondCote Corporation of Pulaski, Va., and identified as TurMesh #C10655 11×11. It will be appreciated that other suitable material porous and non-porous material may be suitably employed for the cover materials.

Figure 3:
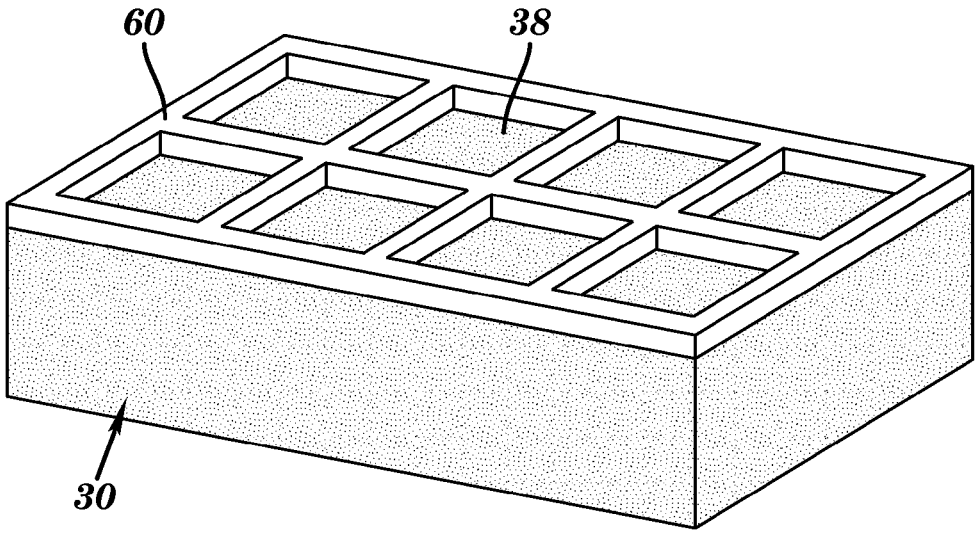
FIG. 3 is a bottom perspective view of the upper padding and the lower support of the high jump landing system having integrated drainage of FIG. 1.

With reference to FIG. 3, upper padding 30 and the lower support 60 may be suitably attached together. In particular, the upper surface 62 (FIG. 2) of lower support 60 may be operably attached using an adhesive or other bonding material such an adhesive manufactured and available from Slocum Adhesives Corporation of Lynchburg, Va., product number S-5267. It will be appreciated that other suitable attachment means may be employed for attaching upper padding 30 and the lower support 60.

Figure 4:
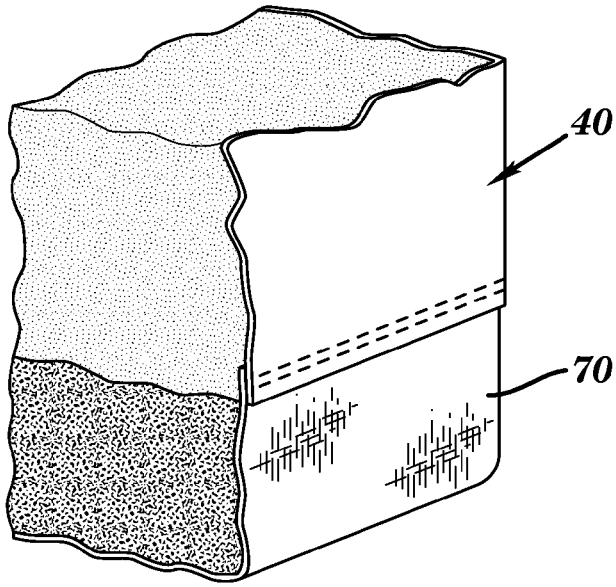
FIG. 4 is a perspective view, partially cutaway, of a lower corner portion of the high jump pit landing system of FIG. 1.

As shown in FIG. 4, the abutting edge portions of upper cover 40 and lower cover 70 may be attached together with, e.g., double stitched seams. In another embodiment, hook-and-loop fasteners such as VELCRO fasteners may be used to attach the edge portions of upper cover 40 and lower cover 70 together. For example, an 8-inch wide strip of VELCRO fasteners may be may be disposed between the upper section and the lower section.

For satisfying the National High School Federation (NFHS) and the National Collegiate Athletic Association (NCAA) specifications and/or requirement, the overall size of the high jump pit pad landing may be about 16½ feet wide, about 8 feet deep, and about 26 inches high, or about 18 feet wide, about 10 feet deep, and about 28 inches high. For satisfying the National High School Federation (NFHS), the National Collegiate Athletic Association (NCAA), and the International Association of Athletics Federations (IAAF) specifications and/or requirements, the overall size of the high jump pit pad landing may be about 20 feet wide, about 13 feet, 2 inches deep, and about 28 inches high.

Figure 5:
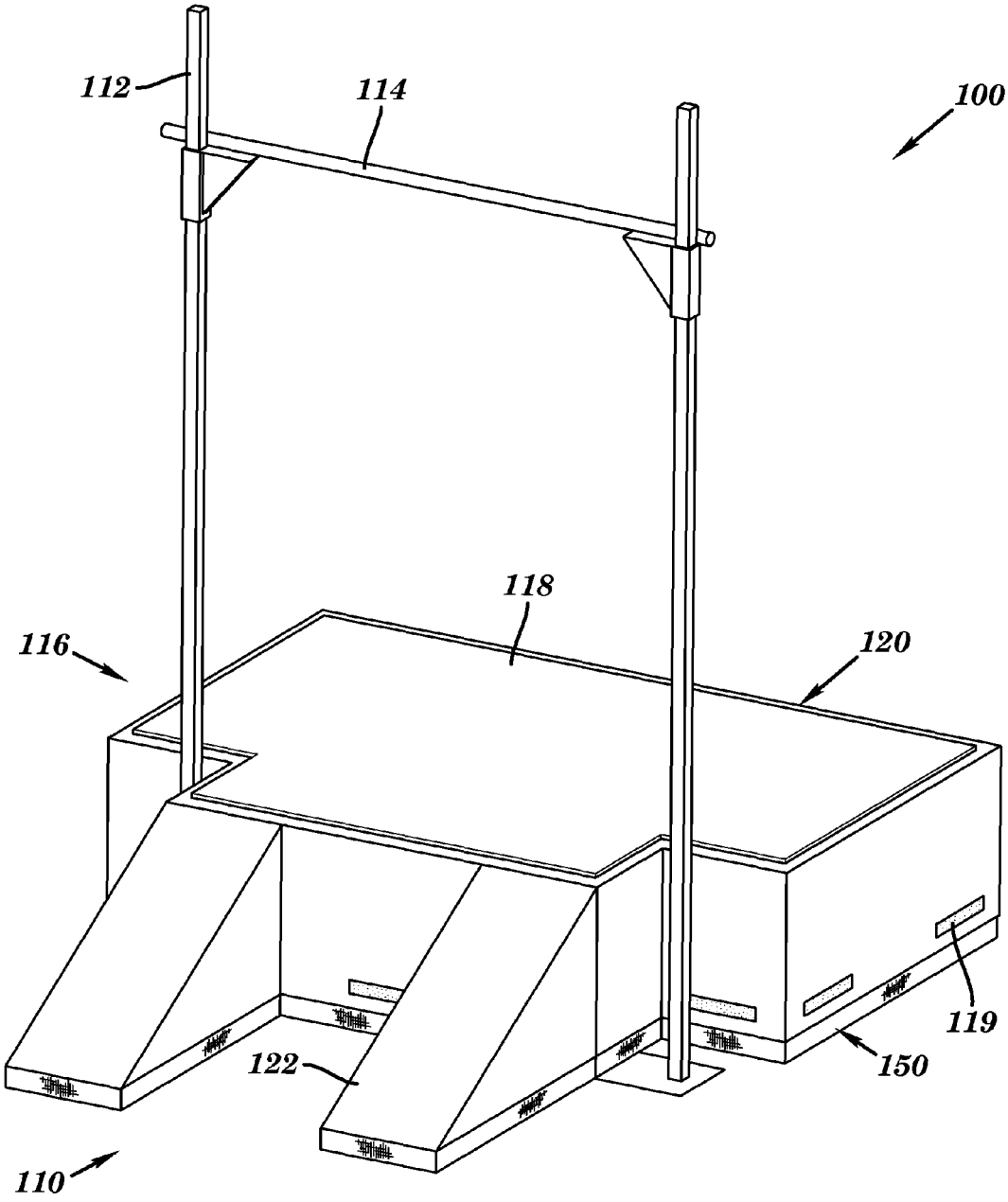
FIG. 5 is a perspective view of one embodiment of a pole vault in accordance with the present invention.

FIG. 5 illustrates one embodiment of a pole vault 100 which may include a plurality of uprights 112, a crossbar 114, and a pit landing system 116 having an integrated drainage system in accordance with the present invention. Pole vault pit landing system 116 includes an upper padding section 120 and a lower support section 150. Two tapering front sections may also include an upper padding section and a lower support section which may also be configured in accordance with the present invention. Additional padding sections may be provided and disposed along the outside of the base of the uprights. The notch portion 110 formed in the front of pole vault landing pad fits around the pole receiving end portion of the pole vault box (not shown). The pole vault box is normally mounted in the ground and the notched portion is positioned in around the pole vault box.

A 2-inch pad 118 may be disposed on top of the pit landing system to protect the upper surface of upper padding section 120. Top pad 118 may be a foam pad covered with heavy-duty vinyl coated polyester mesh that is ultraviolet and spike resistant. A plurality of handles 119 may be provided along the sides of the pit landing system for use in lifting and positioning the pit landing system on a surface of a field such as on the ground within or along side an oval running track. Handles 119 may be 2-inch wide nylon web handles.

Figure 6:
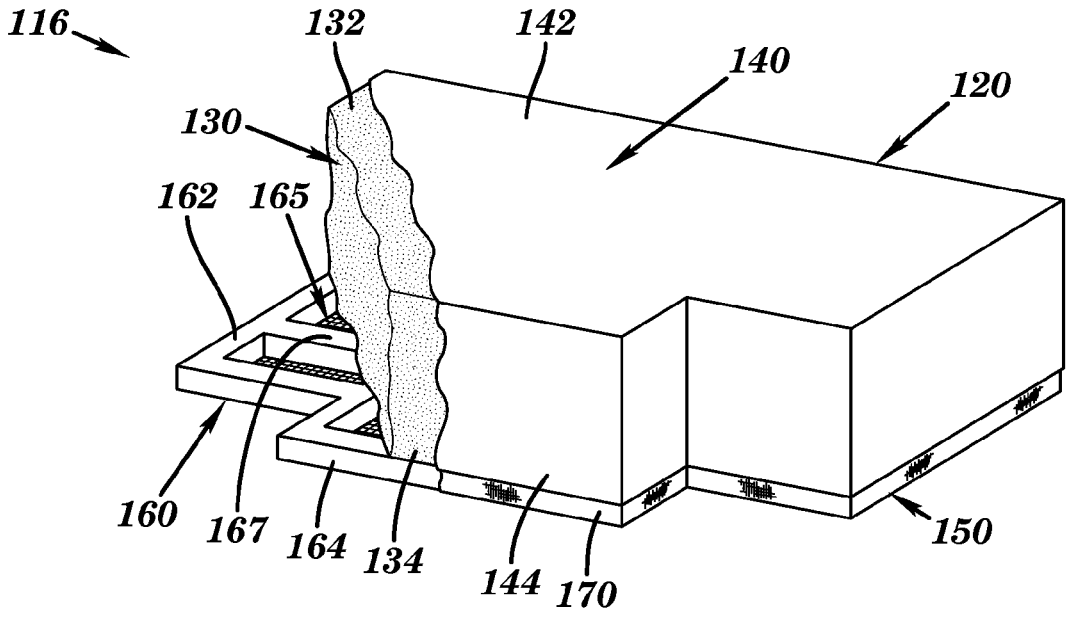
FIG. 6 is a perspective view, partially cutaway, of the pole vault pit landing system having integrated drainage of FIG. 5.

As best shown in FIG. 6, upper padding section 120 includes an upper padding 130 and an upper cover 140. Upper padding 130 may include an upper horizontal surface 132, peripherally-extending side surfaces 134 (only of which is shown in FIG. 6), and a horizontal bottom surface (not shown in FIG. 6). The peripherally-extending side surfaces may include a vertical front side surface, a vertical rear side surface, and vertical right, and left side surfaces. The front right and left corners may have a cutout for permitting receipt of the base of the uprights, and additional padding sections. The thickness of the upper padding between the upper surface and the bottom surface is greater than about 20 inches. The material forming the upper padding may include a suitable "honeycomb" polyurethane foam core comprising different layers.

Upper cover 140 generally covers upper padding 130. For example, cover 140 may be a non-porous cover having a upper portion 142 covering upper surface 132 of upper padding 130, and a peripherally-extending side portion 144 covering peripherally-extending side surfaces 134 of upper padding 130. The peripherally-extending portion 144 of cover 140 may include a vertical front side surface, a vertical rear side surface, and vertical right, and left side surfaces, as well as side surfaces for covering the cutouts in the front corners. Cover portion 140 may be formed form a vinyl material. For example, the non-porous cover portion may be an 18 oz. heavy coated vinyl polyester that has high tear and tensile strengths.

Lower support section 150 comprises a lower support 160 and a lower cover 170. Lower support section 150 is disposed below the lower surface of upper padding section 120. Lower support 160 may include an upper surface 162, peripherally-extending side surfaces 164 (only of which is shown in FIG. 6), and a bottom surface (not shown in FIG. 6). The peripherally-extending side surfaces may include a vertical front side surface, a vertical rear side surface, and vertical right and left side surfaces, as well as side surfaces in the cutouts in the front corners. The thickness of the lower support between the upper surface and the bottom surface of the lower support may be greater than about 2 inches. For example, the thickness may be about 2 inches, about 5 inches, or greater. As described in greater detail below, the material forming the lower support may be operable to allow water to permeate through its structure while supporting the padding layer above the surface of the ground.

Lower porous cover 170 may cover at least the peripherally-extending side surfaces and the bottom surface of lower support 160. For example, the lower cover may extend across the entire bottom surface of the lower support. Lower porous cover 170 may be formed from a vinyl mesh material. For example, lower porous cover 170 may be formed from a 10 oz. woven vinyl coated polyester mesh manufactured and available from BondCote Corporation of Pulaski, Va., and identified as TurMesh #C10655 11×11. It will be appreciated that other suitable material porous and non-porous material may be suitably employed for the cover materials.

The upper padding 130 and the lower support 160 may be attached together. In particular, the upper surface 162 of lower support 160 may be operably attached using an adhesive or other bonding material such an adhesive manufactured and available from Slocum Adhesives Corporation of Lynchburg, Va., product number S-5267. It will be appreciated that other suitable attachment means may be employed for attaching upper padding 130 and the lower support 160.

The abutting edge portions of upper cover 140 and lower cover 170 may be attached together with, e.g., double stitched seams. In another embodiment, hook-and-loop fasteners such as VELCRO fasteners may be used to attach the edge portions of upper cover 140 and lower cover 170 together. For example, an 8-inch wide strip of VELCRO fasteners may be may be disposed between the upper section and the lower section.

For satisfying the National High School Federation (NFHS) specifications and/or requirement, the overall size of the pole vault pit pad landing may be about 19 feet or 21 feet wide, about 20 feet or about 23 feet deep, and about 26 inches or 28 inches high. For satisfying the National High School Federation (NFHS) and the National Collegiate Athletic Association (NCAA) specifications and/or requirement, the overall size of the pole vault pit pad landing may be about 21½ feet wide, about 24 feet deep, and about 32 inches high. For satisfying the National High School Federation (NFHS), the National Collegiate Athletic Association (NCAA), and the International Association of Athletics Federations (IAAF) specifications and/or requirements, the overall size of the high jump pit pad landing may be about 21½ feet wide, about 27 feet deep, and about 32 inches high.

Each of the tapering side portions may also include a tapering upper padding, and a lower support, and upper and lower covers as described above. It sill be appreciated that the front portions may have other suitable configurations, e.g., tapering along the inside of the pole vault box. From the present description, the pole vault pit landing system in accordance with the present invention may also be configured to include a unitary structure comprising both the main central portion and the spaced-apart tapering portions as a single or integrated unit.

With reference again to the high jump pit landing 10 and the pole vault pit landing 110, the lower support structure integrates a drainage layer to the lower portion of the pit padding system. The lower support structure or drainage layer, which may be the same thickness as existing pallets, may be held attached to the upper padding with an adhesive and then covered with a vinyl mesh material which is sewn in place. The end result is a product which allows both water and air to freely move through the lower portions of the jump pit, minimizing the potential for premature failure of the pit system. The lower support structure is sized and configured to provide overall support to the upper portion of the system, yet allows for minimal additional weight.

For example, the lower support comprising a plurality of discrete beads of substantially elastic, resilient material wherein portions of adjacent beads abut one another and other portions of the adjacent beads are spaced from each other to create interstitial spaces therebetween and wherein substantially all of the adjacent beads are integrally joined together at the abutting portions thereof.

With reference again to FIGS. 2 and 6, the lower support may comprise a plurality of open spaces 65 and 165, respectively, extending from the bottom surface of the upper padding to the bottom surface of the lower support. The lower support may include a plurality of horizontally disposed intersecting members 67 and 167, respectively, defining the plurality of open spaces extending between the intersecting member and extending from the bottom surface of the upper padding and the bottom surface of the lower support. The intersecting members may define a plurality of square frames. For example, the open spaces may comprise greater than about 50-percent of the lower support. The open spaces may further comprise greater than about 80-percent to 90-percent of the lower support. Such a configuration provides adequate support for supporting the upper padding off the ground while reducing the added weight.

In one embodiment, the lower support structure may be a porous expanded, beaded polyethylene (EPE) foam which forms a durable yet permeable, lightweight material-offering both drainage and energy absorption. The combination of the lower support and the water permeable lower cover allows for water evacuation both vertically and laterally, and wicking of water away from the bottom of the upper padding. The interconnecting members of the lower support also increases airflow under the upper padding allowing water for evaporation. Thus, the life of the high jump pit landing system and pole vault pit landing system of the present invention may reduce the likelihood of mildew, fungus growth, or rotting, and extending the life of the high jump pit landing system and pole vault pit landing system. The lower support being resilient may also increase resiliency of the entire pit padding safely and may increase safety to athletes. The resilient lower support may reduce the cost of the pit landing system compared to conventional cumbersome pit landings having a separate platform drainage system found in today's market. Also, by integrating the drainage system into the pit landing system as a unitary or one-piece design, no separate installation is necessary, and the pit landing system is easily moved as a single unit.

U.S. Pat. No. 7,244,477 issued to Sawyer et al. and assigned to Brock USA, LLC of Boulder, Colo., the entire subject matter of which is hereby incorporated herein by reference, disclose a suitable water draining layer for use in the lower support for the pit landing system of the present invention. For example, such a lower support may be made of a plurality of discrete beads of substantially elastic, resilient material that can be deformed wherein the beads will rebound to their original shapes. The beads may be distributed substantially uniformly throughout the entire lower support. The elastic, resilient beads may be made of materials such as polyethylene or polypropylene. The beads may have substantially spherical shapes wherein portions of adjacent beads abut one another and other portions are spaced from each other. Additionally, substantially all of the adjacent beads are preferably integrally joined (e.g., glued, fused) together at the abutting portions thereof.

The diameters of the beads can vary as desired (e.g., 1/12 to ⅛ inch or more) but preferably are substantially the same (e.g., ⅛ inch). However, the beads can be a mix of diameter sizes (1/12 to ¼ inches or more). The beads are preferably made of closed cell foam (e.g., polyethylene, or polypropylene) and are waterproof (i.e., non-absorbent). The interstitial spaces between the adjacent beads are in fluid communication with each other and are substantially uniformly spaced or distributed throughout the padding layer.

Such a lower support is very porous and breathable to allow liquids and air to pass freely through the lower support. In addition to being elastic and resilient, the lower support offers excellent water drainage. The porosity of the such a lower support is such that water flows almost without restriction through the lower support via the interstitial spaces between adjacent beads and may pass on the order of 300 inches of water per hour. Because the lower support is breathable due to the interstitial spaces between the beads being in fluid communication with each other, the lower support aids in drying out once the water flow has diminished or ended. In this regard, the air flowing through the spaces will assist in evaporating or dissipating any residual water or moisture.

The density of the lower support (including the foam beads and the bonding agent (e.g., polyurethane) joining the abutting portions of the beads) can vary as desired but preferably is in the range of about 5 pounds per cubic foot to about 10 pounds per cubic foot and desirably about 7 pounds per cubic foot. The foam is preferably closed cell so as to be waterproof (i.e., non-absorbent). Further, for enhanced performance, lower support 7 is preferably mostly air. The interstitial air spaces 15 between the beads in this regard occupy about 25 percent to about 45 percent, and may be about 35 percent to about 45 percent of the total volume of the intersecting member which form the lower support with the beads occupying the remainder. The beads themselves can be about 70 percent to about 90% air and preferably about 80 percent to about 90 percent. Around these general ranges and depending upon the material makeup of the beads, the hardness and resiliency of the lower support can thus be varied as desired but without detracting from the operation of the lower support including its ability to support the upper padding section, to absorb and dissipate forces, and enhance water drainage management. The beads as discussed above are preferably made of elastic, resilient material such as polyethylene or polypropylene but could be made of inelastic, crushable materials such as polystyrene that are essentially incompressible in normal use. The lower support could additionally be a mix or blend of beads of these materials if desired as well as beads of different diameters and of whole and truncated shapes.

Figure 7:
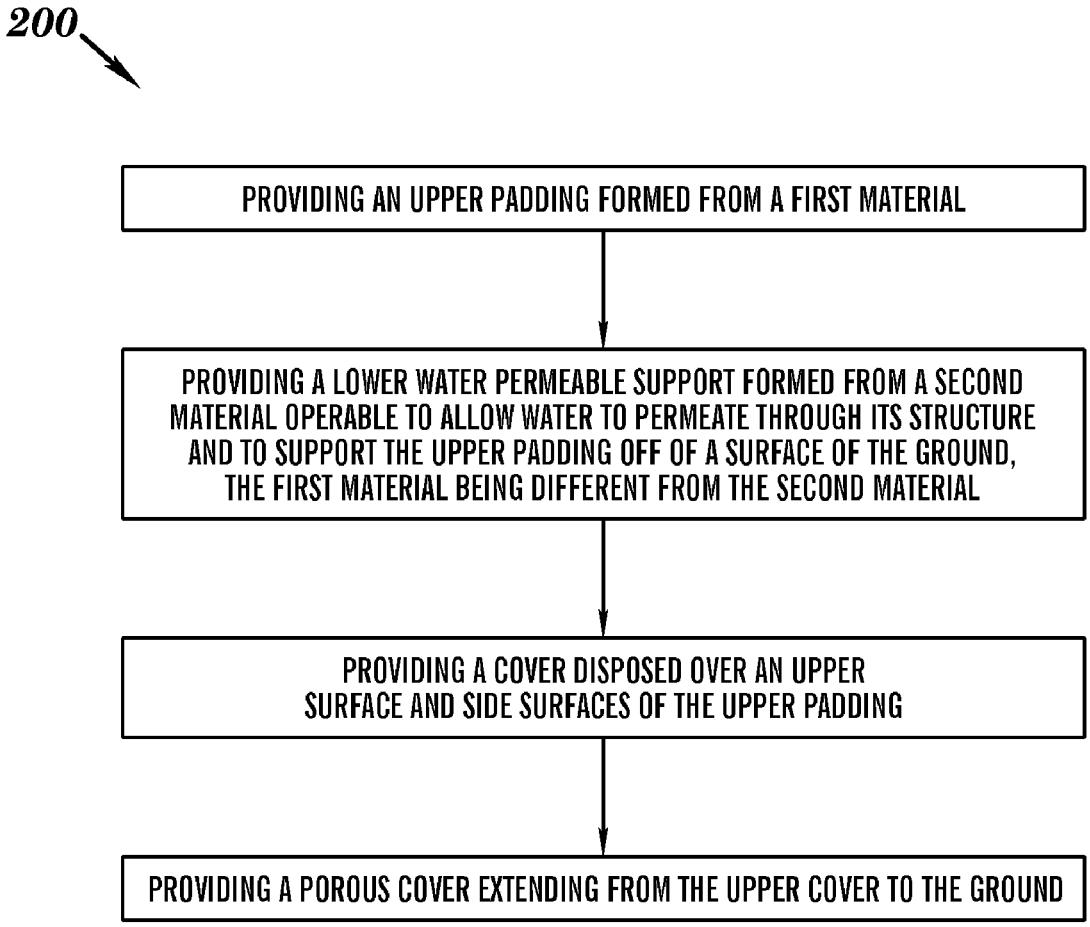
FIG. 7 is a flowchart of a first embodiment for a method for forming a pit landing system having integrated drainage for at least one of a high jump and a pole vault in accordance with the present invention.
Figure 8:
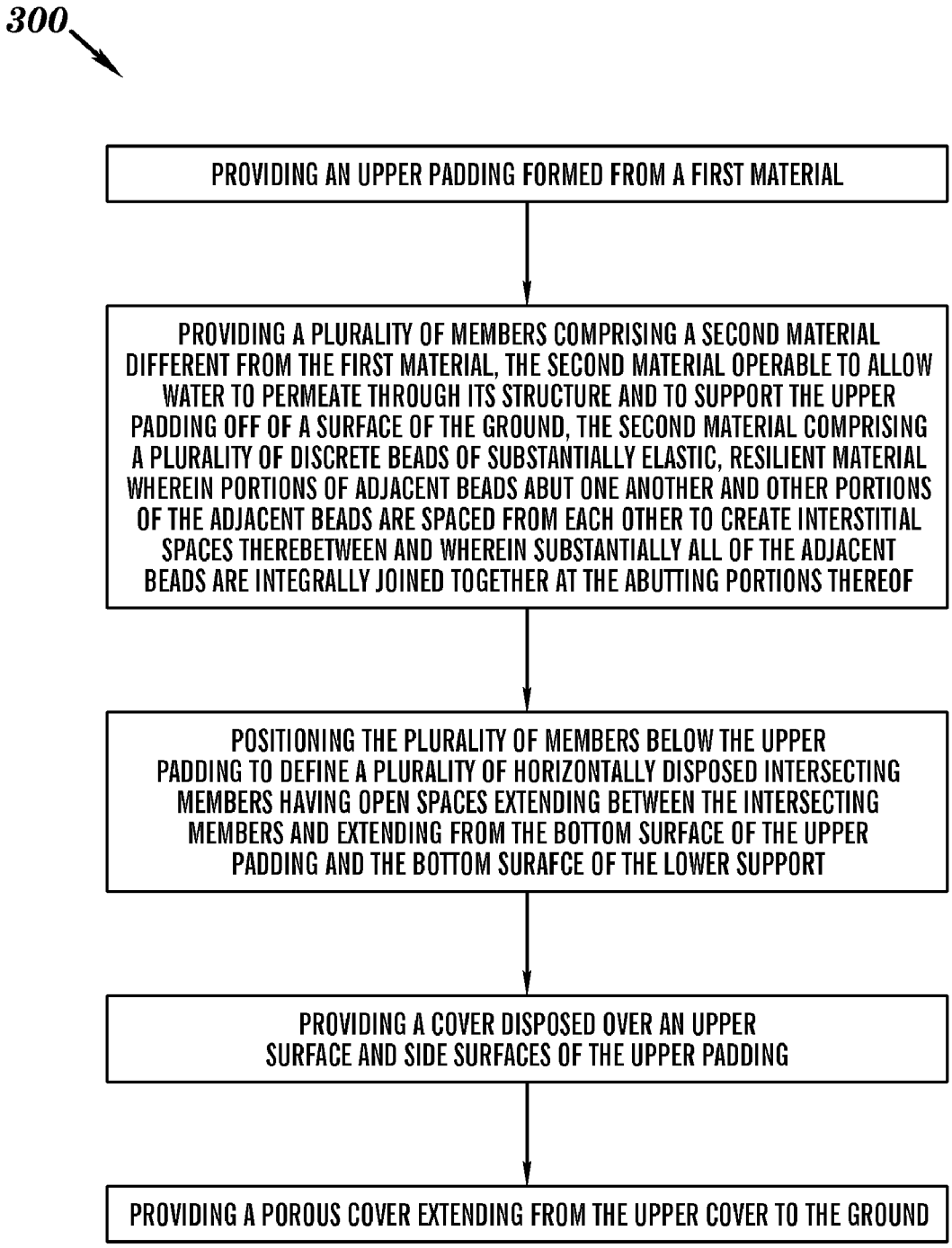
FIG. 8 is a flowchart of a second embodiment for a method for forming a pit landing system having integrated drainage for at least one of a high jump and a pole vault in accordance with the present invention.

FIG. 7 is a flowchart of a first embodiment for a method 200 for forming a pit landing system having integrated drainage for at least one of a high jump and a pole vault in accordance with the present invention. FIG. 8 is a flowchart of a second embodiment for a method 300 for forming a pit landing system having integrated drainage for at least one of a high jump and a pole vault in accordance with the present invention.

As noted above, from the present description, by integrating a drainage system into the pit system, utilizing non-degrading synthetic materials protected by a mesh cover, the owner of the pit landing system is able to procure a one-stop solution for landing pits that may be left in poorly drained or muddy locations. By eliminating the need for metal or synthetic material "pallets" which are both expensive and require additional handling and storage requirements, the present invention reduces the expense in purchasing a pit system as well as minimizes the effort to relocate and store the pit.

Although the invention has been particularly shown and described with reference to certain preferred embodiments, it will be readily appreciated by those of ordinary skill in the art that various changes and modifications may be made therein, without departing from the spirit and scope of the invention.

The invention claimed is:

1. A pit landing system having integrated drainage positionable on a surface of a ground for at least one of a high jump and a pole vault, said pit landing system comprising:

an upper padding section comprising:

an upper padding having an upper surface, a bottom surface, side surfaces extending between said upper surface and said bottom surface, and a thickness between said upper surface and said bottom surface of greater than about 20 inches;

an upper cover covering said upper surface and side surfaces of said upper padding layer;

a lower support section disposed below said lower surface of said upper padding for supporting the upper padding section off the ground, said lower support section comprising:

a lower water permeable support having an upper surface, a bottom surface, and a thickness between the upper surface and the bottom surface of the lower support greater than about 2 inches, said lower support operable to allow water to permeate through its structure while supporting said padding layer above the surface of the ground, said upper padding comprising a first material and said lower water permeable support comprising a second material which is different from said first material, said lower support comprising a plurality of discrete beads of substantially elastic, resilient material wherein portions of adjacent beads abut one another and other portions of said adjacent beads are spaced from each other to create interstitial spaces therebetween and wherein substantially all of said adjacent beads are integrally joined together at the abutting portions thereof; and a porous cover extending from said upper cover and covering side surfaces of said lower support.

2. The pit landing system of claim 1 wherein said lower support comprises a plurality of open spaces extending from said bottom surface of said upper padding to said bottom surface of said lower support, and wherein said open spaces comprises greater than about 50-percent of said lower support.

3. The pit landing system of claim 1 wherein said lower support comprises a plurality of horizontally disposed intersecting members defining a plurality of open spaces extending between said plurality of horizontally disposed intersecting members and extending from said bottom surface of said upper padding and said bottom surface of said lower support.

4. The pit landing system of claim 3 wherein said plurality of horizontally disposed intersecting members of said lower support defines a plurality of square frames.

5. The pit landing system of claim 3 wherein said open spaces comprises greater than about 50-percent of said lower support.

6. The pit landing system of claim 1 wherein said lower support comprises a height of 2 inches.

7. The pit landing system of claim 1 wherein said upper surface of said lower support is attached to said bottom surface of said upper padding to form a unitary pit landing system.

8. The pit landing system of claim 1 wherein said lower cover extends across the entire bottom surface of said lower support.

9. The pit landing system of claim 1 wherein an upper portion of said porous cover is sewn to a lower portion of said upper cover.

10. The pit landing system of claim 1 wherein porous cover comprises a mesh fabric.

11. The pit landing system of claim 1 wherein said upper cover comprise a non-water permeable cover.

12. A high jump comprising:

the pit landing system of claim 1;

a plurality of uprights disposable along side the pit landing system; and a crossbar disposable between the plurality of uprights.

13. A pole vault comprising:

the pit landing system of claim 1;

a plurality of uprights disposable along side the pit landing system; and a crossbar disposable between the plurality of uprights.

14. A stadium comprising:

a field; and the pit landing system of claim 1 disposed on the field.

15. A method for protecting an athlete performing at least one of a high jump and a pole vault, the method comprising:

providing the pit landing system of claim 1 on a field;

positioning a plurality of uprights along side the pit landing system;

positioning a crossbar between the plurality of uprights; and receiving the athlete on pit landing system after the athlete at least one of attempts to pass over and passes over the crossbar.

16. The method of claim 15 further comprising allowing water to pass through the lower section.

17. A pit landing system having integrated drainage positionable on a surface of a ground for at least one of a high jump and a pole vault, said pit landing system comprising:

an upper padding section comprising:

an upper padding having an upper surface, a bottom surface, side surfaces extending between said upper surface and said bottom surface, and a thickness between the upper surface and the bottom surface of greater than about 20 inches;

an upper cover covering said upper surface and said side surfaces of said upper padding layer;

a lower support section disposed below said lower surface of said upper padding for supporting the upper padding section off the ground, said lower support section comprising:

a lower water permeable support having an upper surface, a bottom surface, and a thickness between the upper surface and the bottom surface of the lower support greater than about 2 inches, said upper padding comprising a first material, and said lower water permeable support comprising a second material which is different from said first material;

said lower support comprising a plurality of discrete beads of substantially elastic, resilient material wherein portions of adjacent beads abut one another and other portions of said adjacent beads are spaced from each other to create interstitial spaces therebetween and wherein substantially all of said adjacent beads are integrally joined together at the abutting portions thereof;

said lower support comprises a plurality of horizontally disposed intersecting members defining a plurality of open spaces extending between said intersecting member and extending from said bottom surface of said upper padding and said bottom surface of said lower support;

said open spaces comprising greater than about 50-percent of said lower support;

a porous cover covering said bottom surface and said side surfaces of said lower support.

18. The pit landing system of claim 17 wherein said plurality of horizontally disposed intersecting members defines a plurality of square frames.

19. The pit landing system of claim 17 wherein said lower support comprises a height of 2 inches.

20. The pit landing system of claim 17 wherein said upper surface of said lower support is attached to said bottom surface of said upper padding to form a unitary pit landing system.

21. The pit landing system of claim 17 wherein said lower cover extends across the entire bottom surface of said lower support.

22. The pit landing system of claim 17 wherein said beads comprise at least one of polypropylene and polyethylene.

23. The pit landing system of claim 17 wherein said interstitial spaces between said other portions of said adjacent beads are in fluid communication with one another.

24. The pit landing system of claim 17 wherein an upper portion of said porous cover is sewn to a lower portion of said upper cover.

25. The pit landing system of claim 17 wherein porous cover comprises a mesh fabric.

26. The pit landing system of claim 17 wherein said upper cover comprise a non-water permeable cover.

27. A high jump comprising:

the pit landing system of claim 17;

a plurality of uprights along side the pit landing system; and a crossbar between the plurality of uprights.

28. A pole vault comprising:

the pit landing system of claim 17;

a plurality of uprights along side the pit landing system; and a crossbar between the plurality of uprights.

29. A stadium comprising:

a field; and the pit landing system of claim 17 disposed on the field.

30. A method for protecting an athlete performing at least one of a high jump and a pole vault, the method comprising:

providing the pit landing system of claim 17 on a field;

positioning a plurality of uprights along side the pit landing system;

positioning a crossbar between the plurality of uprights; and receiving the athlete on pit landing system after the athlete at least one of attempts to pass over and passes over the crossbar.

31. The method of claim 30 further comprising allowing water to pass through the lower section.

32. A method for forming a pit landing system having integrated drainage for at least one of a high jump and a pole vault, the method comprising:

providing an upper padding formed from a first material;

providing a lower water permeable support formed from a second material operable to allow water to permeate through its structure and to support the upper padding off of a surface of the ground, the first material being different from the second material;

providing a cover disposed over an upper surface and side surfaces of the upper padding; and providing a porous cover extending from the upper cover to the ground.

33. The method of claim 32 further comprising operably attaching the lower support to the upper padding, and operably attaching a lower portion of the upper cover to an upper portion of the lower cover, so that the pit landing system having an integrated drainage comprises a unitary structure.

34. The method of claim 32 wherein the supporting comprises supporting the upper padding section above the surface of the ground on the lower support section comprising plurality of discrete beads of substantially elastic, resilient material wherein portions of adjacent beads abut one another and other portions of the adjacent beads are spaced from each other to create interstitial spaces therebetween and wherein substantially all of the adjacent beads are integrally joined together at the abutting portions thereof.

35. The method of claim 32 wherein the supporting comprises configuring the lower support to have a plurality of open spaces extending from the bottom surface of the upper padding to the bottom surface of the lower support, and wherein the open spaces comprises greater than about 50-percent of the lower support.

36. The method of claim 32 wherein the supporting comprises forming the lower support from a plurality of horizontally disposed intersecting members.

37. The method of claim 32 further comprising allowing water to pass through the lower section.

38. A method for forming a pit landing system having integrated drainage for at least one of a high jump and a pole vault, the method comprising:

providing an upper padding formed from a first material;

providing a plurality of members comprising a second material different from the first material, the second material operable to allow water to permeate through its structure and to support the upper padding off of a surface of the ground, the second material comprising a plurality of discrete beads of substantially elastic, resilient material wherein portions of adjacent beads abut one another and other portions of the adjacent beads are spaced from each other to create interstitial spaces therebetween and wherein substantially all of the adjacent beads are integrally joined together at the abutting portions thereof;

positioning the plurality of members below the upper padding to define a plurality of horizontally disposed intersecting member having open spaces extending between the intersecting members and extending from the bottom surface of the upper padding and the bottom surface of the lower support;

providing a cover disposed over an upper surface and side surfaces of the upper padding; and providing a porous cover extending from the upper cover to the ground.

39. The method of claim 38 further comprising operably attaching the lower support to the upper padding, and operably attaching a lower portion of the upper cover to an upper portion of the lower cover, so that the pit landing system having an integrated drainage comprises a unitary structure.

40. The method of claim 38 further comprising allowing water to pass through the lower section.

41. A method for protecting an athlete performing at least one of a high jump and a pole vault, the method comprising:

providing the pit landing system on a field, the pit landing comprising:

an upper padding section comprising:

an upper padding having an upper surface, a bottom surface, side surfaces extending between said upper surface and said bottom surface, and a thickness between said upper surface and said bottom surface of greater than about 20 inches;

an upper cover covering said upper surface and side surfaces of said upper padding layer;

a lower support section disposed below said lower surface of said upper padding for supporting the upper padding section off the ground, said lower support section comprising:

a lower water permeable support having an upper surface, a bottom surface, and a thickness between the upper surface and the bottom surface of the lower support greater than about 2 inches, said lower support operable to allow water to permeate through its structure while supporting said padding layer above the surface of the ground, said upper padding comprising a first material and said lower water permeable support comprising a second material which is different from said first material; and a porous cover extending from said upper cover and covering side surfaces of said lower support;

positioning a plurality of uprights along side the pit landing system;

positioning a crossbar between the plurality of uprights; and receiving the athlete on pit landing system after the athlete at least one of attempts to pass over and passes over the crossbar.

42. The method of claim 41 further comprising allowing water to pass through the lower section.

43. A pit landing system having integrated drainage positionable on a surface of a ground for at least one of a high jump and a pole vault, said pit landing system comprising:

an upper padding section comprising:

an upper padding having an upper surface, a bottom surface, side surfaces extending between said upper surface and said bottom surface, and a thickness between said upper surface and said bottom surface of greater than about 20 inches;

an upper cover covering said upper surface and side surfaces of said upper padding layer;

a lower support section disposed below said lower surface of said upper padding for supporting the upper padding section off the ground, said lower support section comprising:

a lower water permeable support having an upper surface, a bottom surface, and a thickness between the upper surface and the bottom surface of the lower support greater than about 2 inches, said lower support operable to allow water to permeate through its structure while supporting said padding layer above the surface of the ground, said upper padding comprising a first material and said lower water permeable support comprising a second material which is different from said first material;

a porous cover extending from said upper cover and covering side surfaces of said lower support; and wherein said lower cover extends across the entire bottom surface of said lower support.

44. At least one of a high jump and a pole vault comprising:

the pit landing system of claim 43;

a plurality of uprights along side the pit landing system; and a crossbar between the plurality of uprights.

45. A stadium comprising:

a field; and the pit landing system of claim 43 disposed on the field.

46. A method for protecting an athlete performing at least one of a high jump and a pole vault, the method comprising:

providing the pit landing system of claim 43 on a field;

positioning a plurality of uprights along side the pit landing system;

positioning a crossbar between the plurality of uprights; and receiving the athlete on pit landing system after the athlete at least one of attempts to pass over and passes over the crossbar.

47. The method of claim 46 further comprising allowing water to pass through the lower section.

48. A pit landing system having integrated drainage positionable on a surface of a ground for at least one of a high jump and a pole vault, said pit landing system comprising:

an upper padding section comprising:

an upper padding having an upper surface, a bottom surface, side surfaces extending between said upper surface and said bottom surface, and a thickness between said upper surface and said bottom surface of greater than about 20 inches;

an upper cover covering said upper surface and side surfaces of said upper padding layer;

a lower support section disposed below said lower surface of said upper padding for supporting the upper padding section off the ground, said lower support section comprising:

a lower water permeable support having an upper surface, a bottom surface, and a thickness between the upper surface and the bottom surface of the lower support greater than about 2 inches, said lower support operable to allow water to permeate through its structure while supporting said padding layer above the surface of the ground, said upper padding comprising a first material and said lower water permeable support comprising a second material which is different from said first material;

a porous cover extending from said upper cover and covering side surfaces of said lower support; and wherein an upper portion of said porous cover is sewn to a lower portion of said upper cover.

49. At least one of a high jump and a pole vault comprising:

the pit landing system of claim 48;

a plurality of uprights along side the pit landing system; and a crossbar between the plurality of uprights.

50. A stadium comprising:

a field; and the pit landing system of claim 48 disposed on the field.

51. A method for protecting an athlete performing at least one of a high jump and a pole vault, the method comprising:

providing the pit landing system of claim 48 on a field;

positioning a plurality of uprights along side the pit landing system;

positioning a crossbar between the plurality of uprights; and receiving the athlete on pit landing system after the athlete at least one of attempts to pass over and passes over the crossbar.

52. The method of claim 51 further comprising allowing water to pass through the lower section.

53. A pit landing system having integrated drainage positionable on a surface of a ground for at least one of a high jump and a pole vault, said pit landing system comprising:

an upper padding section comprising:

an upper padding having an upper surface, a bottom surface, side surfaces extending between said upper surface and said bottom surface, and a thickness between said upper surface and said bottom surface of greater than about 20 inches;

an upper cover covering said upper surface and side surfaces of said upper padding layer;

a lower support section disposed below said lower surface of said upper padding for supporting the upper padding section off the ground, said lower support section comprising:

a lower water permeable support having an upper surface, a bottom surface, and a thickness between the upper surface and the bottom surface of the lower support greater than about 2 inches, said lower support operable to allow water to permeate through its structure while supporting said padding layer above the surface of the ground, said upper padding comprising a first material and said lower water permeable support comprising a second material which is different from said first material;

a porous cover extending from said upper cover and covering side surfaces of said lower support; and wherein porous cover comprises a mesh fabric.

54. At least one of a high jump and a pole vault comprising:

the pit landing system of claim 53;

a plurality of uprights along side the pit landing system; and a crossbar between the plurality of uprights.

55. A stadium comprising:

a field; and the pit landing system of claim 53 disposed on the field.

56. A method for protecting an athlete performing at least one of a high jump and a pole vault, the method comprising:

providing the pit landing system of claim 53 on a field;

positioning a plurality of uprights along side the pit landing system;

positioning a crossbar between the plurality of uprights; and receiving the athlete on pit landing system after the athlete at least one of attempts to pass over and passes over the crossbar.

57. The method of claim 56 further comprising allowing water to pass through the lower section.

* * * * *